US011420313B2

(12) United States Patent
Wang

(10) Patent No.: US 11,420,313 B2
(45) Date of Patent: Aug. 23, 2022

(54) STAPLE GUN

(71) Applicant: APEX MFG. CO., LTD., Taichung (TW)

(72) Inventor: Jing-Li Wang, Taichung (TW)

(73) Assignee: APEX MFG. CO., LTD., Taichung (TW)

( * ) Notice: Subject to any disclaimer, the term of this patent is extended or adjusted under 35 U.S.C. 154(b) by 355 days.

(21) Appl. No.: 16/505,167

(22) Filed: Jul. 8, 2019

(65) Prior Publication Data

US 2021/0008703 A1 Jan. 14, 2021

(51) Int. Cl.
*B25C 5/11* (2006.01)
*B25C 5/06* (2006.01)

(52) U.S. Cl.
CPC . *B25C 5/11* (2013.01); *B25C 5/06* (2013.01)

(58) Field of Classification Search
CPC ..... B25C 5/11; B25C 5/06
USPC ..... 227/107–135, 139
See application file for complete search history.

(56) References Cited

U.S. PATENT DOCUMENTS 1,457,446 A * 6/1923 Michener ..... A43D 69/04 227/132
2,746,043 A * 5/1956 Zaller ..... B25C 5/16 227/127
2,746,044 A * 5/1956 Cusumano ..... B25C 5/06 227/132
2,936,456 A * 5/1960 Ruskin ..... B25C 5/10 227/126
3,610,505 A * 10/1971 Males ..... B25C 5/10 227/127
3,873,016 A * 3/1975 Fishbein ..... A61B 17/0684 227/83
3,948,426 A * 4/1976 La Pointe ..... B25C 5/10 227/8
4,119,258 A * 10/1978 Ewig, Jr. ..... B25C 5/06 227/132
4,133,468 A * 1/1979 Ewig ..... B25C 5/10 227/126
4,184,620 A * 1/1980 Ewig ..... B25C 5/06 227/128
4,452,388 A * 6/1984 Fealey ..... B25C 5/10 227/123
5,364,000 A * 11/1994 Fealey ..... B25C 5/0285 227/124
7,604,149 B2 * 10/2009 Tsai ..... B25C 5/11 227/132

(Continued)

FOREIGN PATENT DOCUMENTS

DE 102008005459 A1 * 7/2009 ..... B25C 5/0242
DE 202019103200 U1 * 8/2019 ..... B25C 5/11

*Primary Examiner* — Robert F Long
(74) *Attorney, Agent, or Firm* — Muncy, Geissler, Olds & Lowe, P.C.

(57) ABSTRACT

A staple gun includes a housing, a striking member, a driving mechanism and a locking mechanism. The housing includes a staple outlet. The striking member is disposed on the housing. The driving mechanism includes a pressure bar which is rotatably assembled with the housing. The locking mechanism includes a locking member. The locking member is assembled with the housing and is rotatable about an axial direction to be in a locking position or a releasing position. The locking member has a stopping bump formed radially.

10 Claims, 8 Drawing Sheets

(56) References Cited

U.S. PATENT DOCUMENTS

| | | | | |
|---|---|---|---|---|
| 7,770,771 | B2 * | 8/2010 | Tsai | B25C 5/1644 227/109 |
| 8,833,626 | B2 * | 9/2014 | Perron | B25C 1/008 227/138 |
| 2005/0023325 | A1 * | 2/2005 | Gresham | A61B 17/115 227/176.1 |
| 2010/0012700 | A1 * | 1/2010 | Perron | B25C 1/043 227/8 |
| 2010/0116863 | A1 * | 5/2010 | Suda | B25C 1/06 227/8 |
| 2013/0228605 | A1 * | 9/2013 | Wang | B25C 5/11 227/8 |
| 2014/0231486 | A1 * | 8/2014 | Burch | B25C 5/0285 227/63 |
| 2014/0374462 | A1 * | 12/2014 | Ebbesson | B25C 5/11 227/146 |
| 2015/0041516 | A1 * | 2/2015 | Chen | B25C 5/11 227/107 |
| 2016/0303726 | A1 * | 10/2016 | Hu | B25C 5/1606 |
| 2018/0215025 | A1 * | 8/2018 | Marks | B25C 5/06 |
| 2019/0232476 | A1 * | 8/2019 | Wang | B25C 5/11 |
| 2020/0046353 | A1 * | 2/2020 | Deck | A61B 17/07207 |
| 2021/0008702 | A1 * | 1/2021 | Wang | B25C 5/11 |

* cited by examiner

STAPLE GUN

BACKGROUND OF THE INVENTION

Field of the Invention

The present invention relates to a staple gun.

DESCRIPTION OF THE PRIOR ART

A staple gun includes an elastic plate, a lever and a striker which are disposed on a housing. The striker is connected with the elastic plate and lever. When the lever is pressed, the lever will drive the elastic plate to accumulated force for driving the striker. When the lever is pressed to be in a releasing position, the striker is disengaged from the lever, and the striker is driven by the elastic plate to strike the staple. To avoid unexpected striking of the staple, a swingable limiting member is disposed on an end of the staple gun away from the staple outlet. The lever is pressed to approach the housing and then locked. US20180215025 discloses this kind of staple gun.

However, since the limiting member is exposed outside the housing, the limit member is easy to be unlocked, damaged or detached. To lock the lever, it has to strike the staple one time so that the lever can reach the locking position. To unlock the lever, it needs a hand to press the lever and the other hand has to release the limiting member from the lever, thus being inconvenient. In addition, the staple gun with the limiting member has a complicated structure and is not aesthetic.

The present invention is, therefore, arisen to obviate or at least mitigate the above-mentioned disadvantages.

SUMMARY OF THE INVENTION

The main object of the present invention is to provide a staple gun having two kinds of locking, in which unexpected striking of the staple can be avoided and the staple gun can be quickly unlocked.

To achieve the above and other objects, the present invention provides a staple gun, including: a housing, including a staple outlet; a striking member, disposed on the housing and being movable toward or away from the staple outlet; a driving mechanism, including a lever rotatably connected to the housing, the lever being swingable between a first position and a second position, the driving mechanism driving the striking member to move toward the staple outlet when the lever swings from the first position toward the second position; a locking mechanism, including a locking member, the locking member disposed on the housing and rotatable about an axial direction between a releasing position and a locking position, the locking member including a stopping bump which protrudes radially and is located inside the housing; wherein when the locking mechanism is in the releasing position, the locking mechanism is free of inference with the lever, and the lever is freely rotatable between the first position and the second position; when the lever swings toward the second position and the locking member rotates to be in the locking position, the stopping bump is abutted against a part of the lever which is located inside the housing so that the lever is stopped by the stopping bump and non-movable toward the first position.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
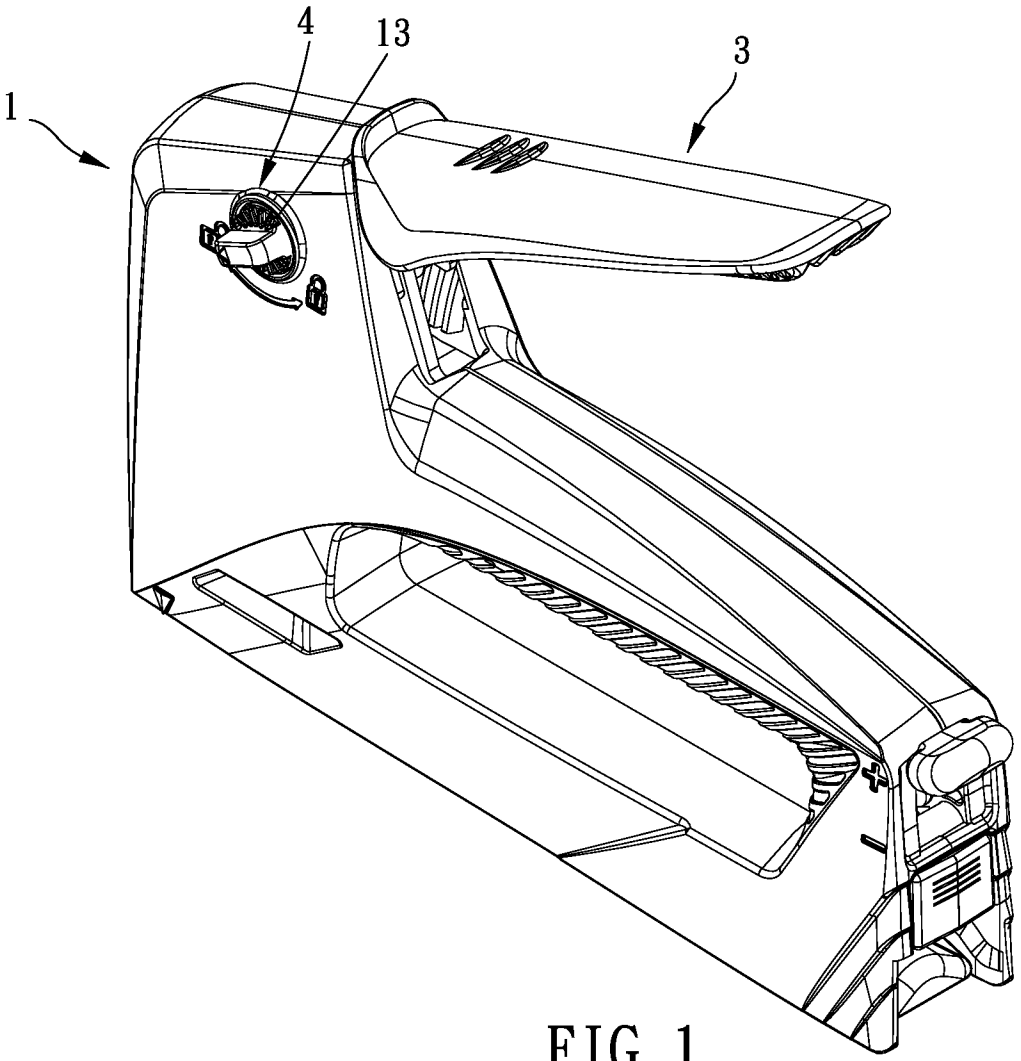
FIG. 1 is a stereogram of a preferable embodiment of the present invention.
Figure 2:
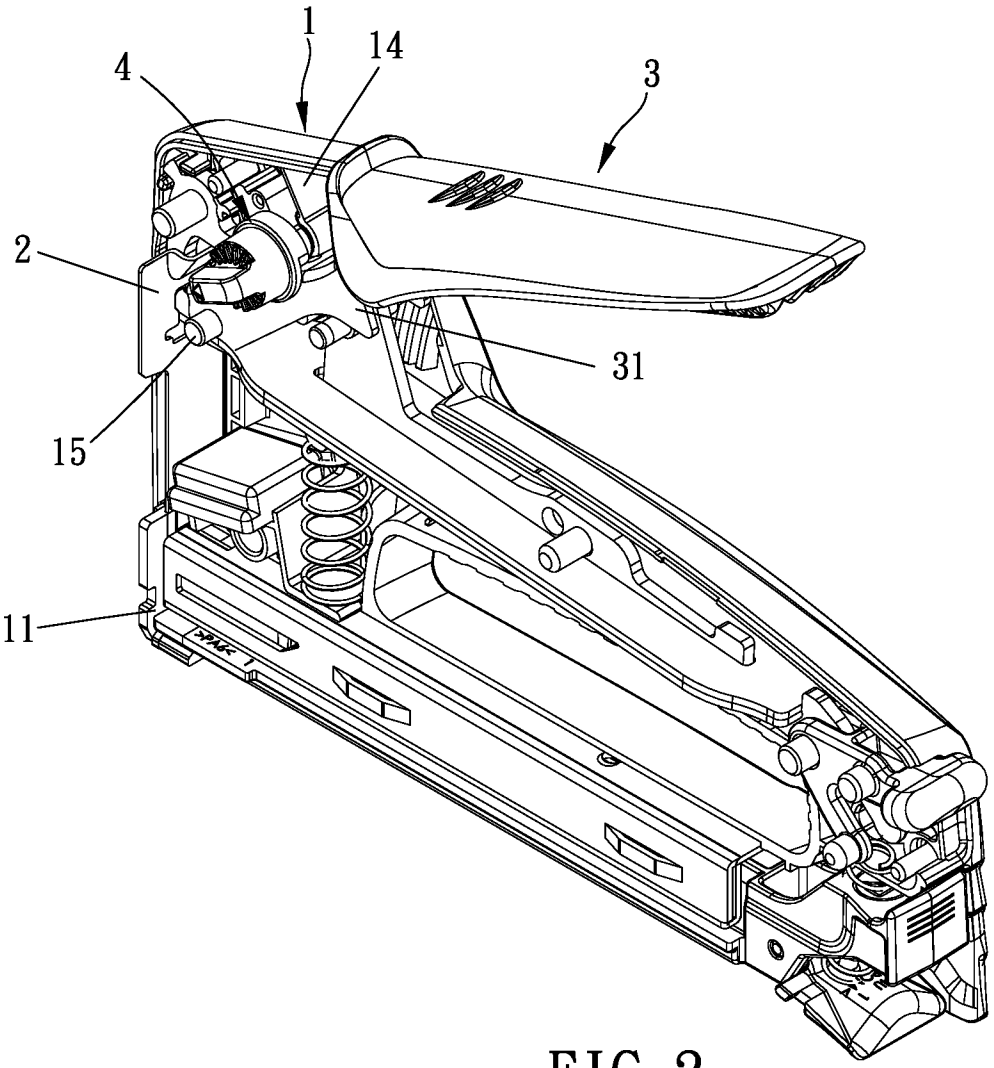
FIG. 2 is a drawing showing a part of a staple gun according to a preferable embodiment of the present invention.
Figures 3, 4, 5:
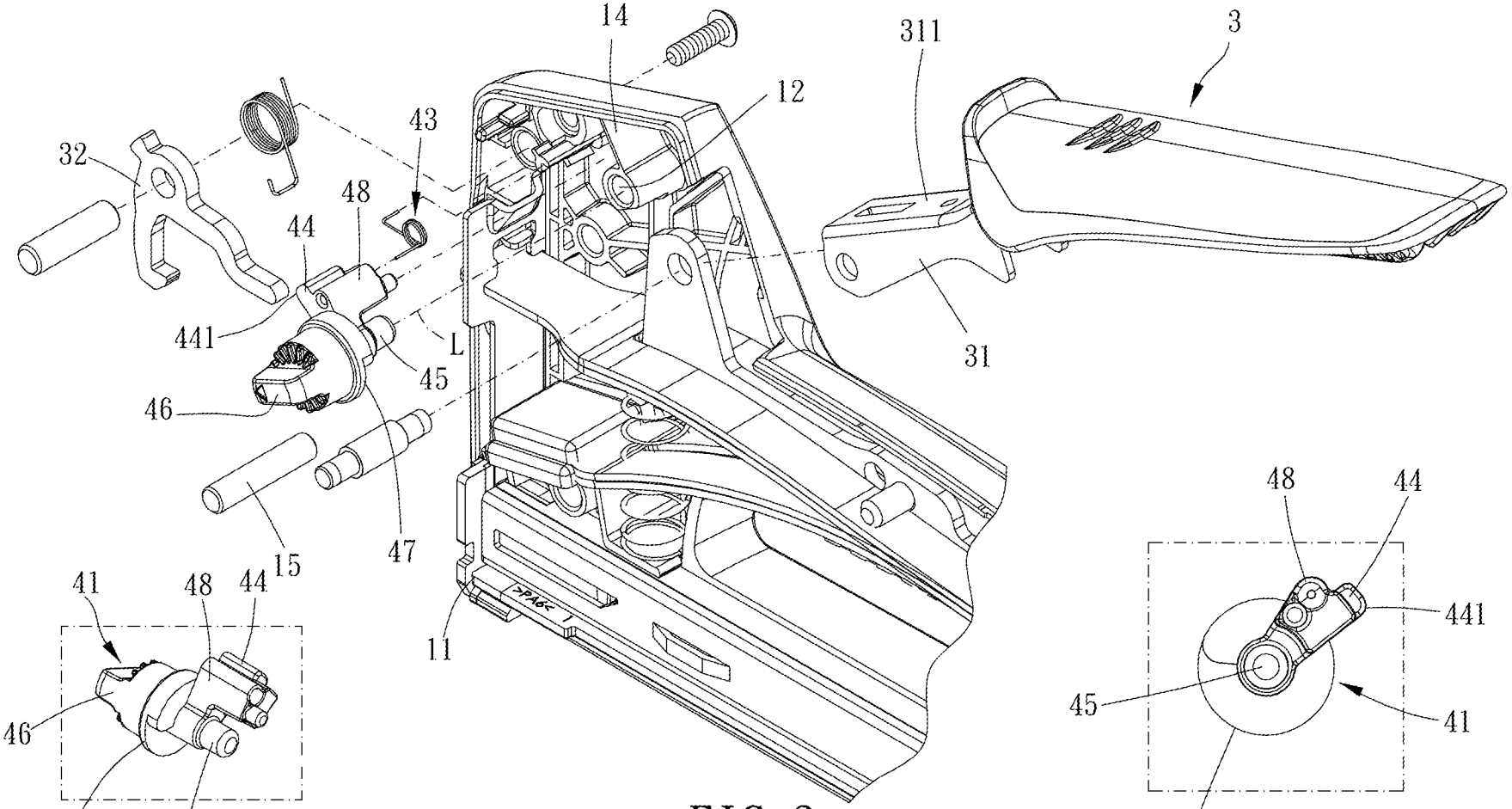
FIG. 3 is a partial breakdown drawing of a preferable embodiment of the present invention.
FIG. 4 is a drawing showing a locking member according to a preferable embodiment of the present invention.
FIG. 5 is a side view of FIG. 4.

Please refer to FIGS. 1 to 10 for a preferable embodiment of the present invention. A staple gun includes a housing 1, a striking member 2, a driving mechanism 3 and a locking mechanism 4.

The housing 1 includes a staple outlet 11.

The striking member 2 is disposed on the housing 1 and being movable toward or away from the staple outlet 11 movable.

The driving mechanism 3 includes a lever 31 rotatably connected to the housing 1, the lever 31 is swingable between a first position and a second position, and the driving mechanism 3 drives the striking member 2 to move toward the staple outlet 11 when the lever 31 swings from the first position swings toward the second position. In this embodiment, the driving mechanism 3 further includes a retaining member 32 rotatably connected to the housing 1. When the lever 31 is in the first position, the retaining member 32 and the striking member 2 are positionably engaged with each other so that the elastic plate of the staple gun accumulates force; when the lever 31 move to the second position, the retaining member 32 is driven by the lever 31 to disengage from the striking member 2 so that the striking member 2 is movable toward the staple outlet 11 to strike the staple at the staple outlet 11.

The locking mechanism 4 includes a locking member 41, the locking member 41 is disposed on the housing 1 and rotatable about an axial direction between a releasing position and a locking position, and the locking member 41 includes a stopping bump 44 which protrudes radially and is located inside the housing 1.

Figure 6:
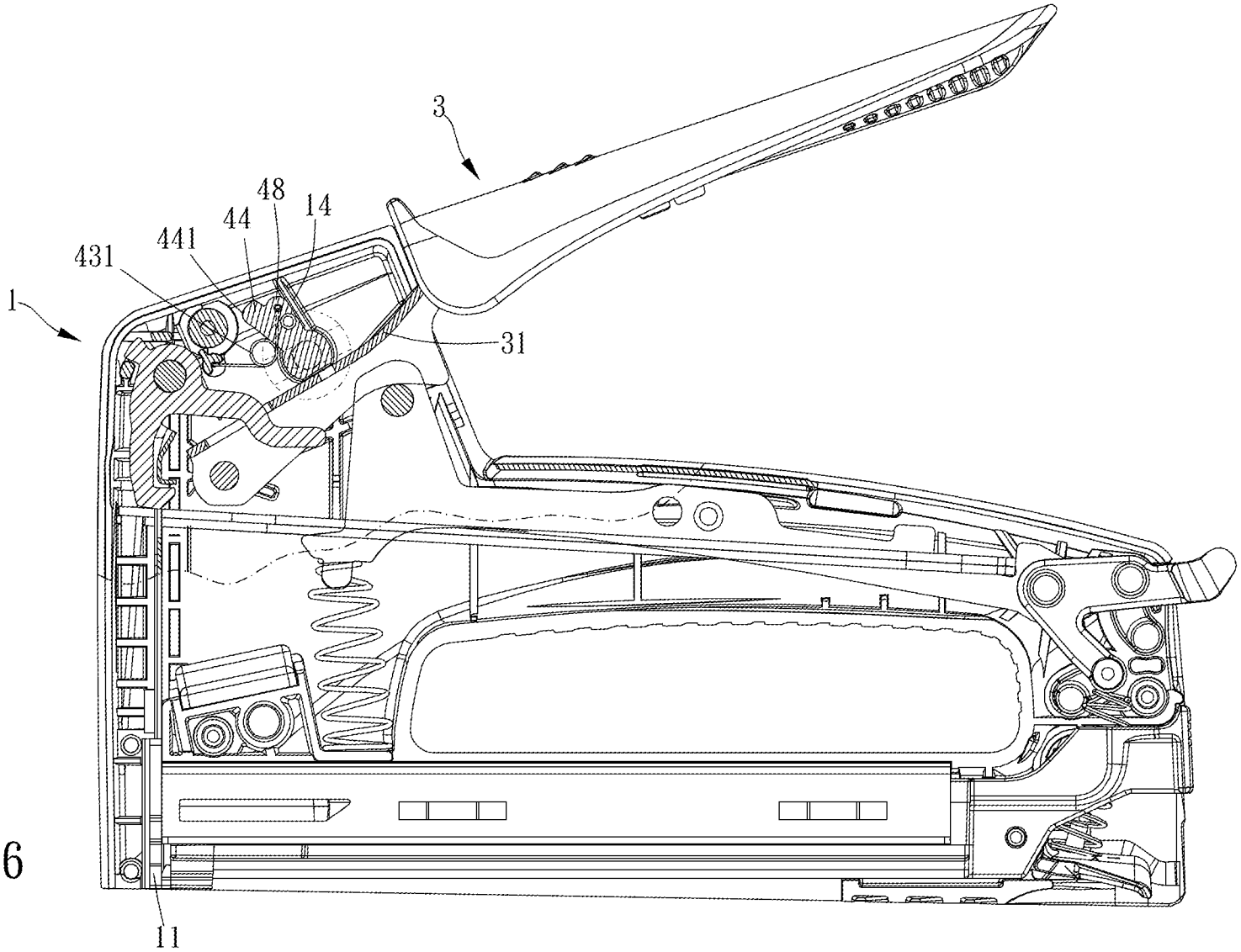
FIG. 6 is a cross-sectional view of a preferable embodiment of the present invention.
Figure 7:
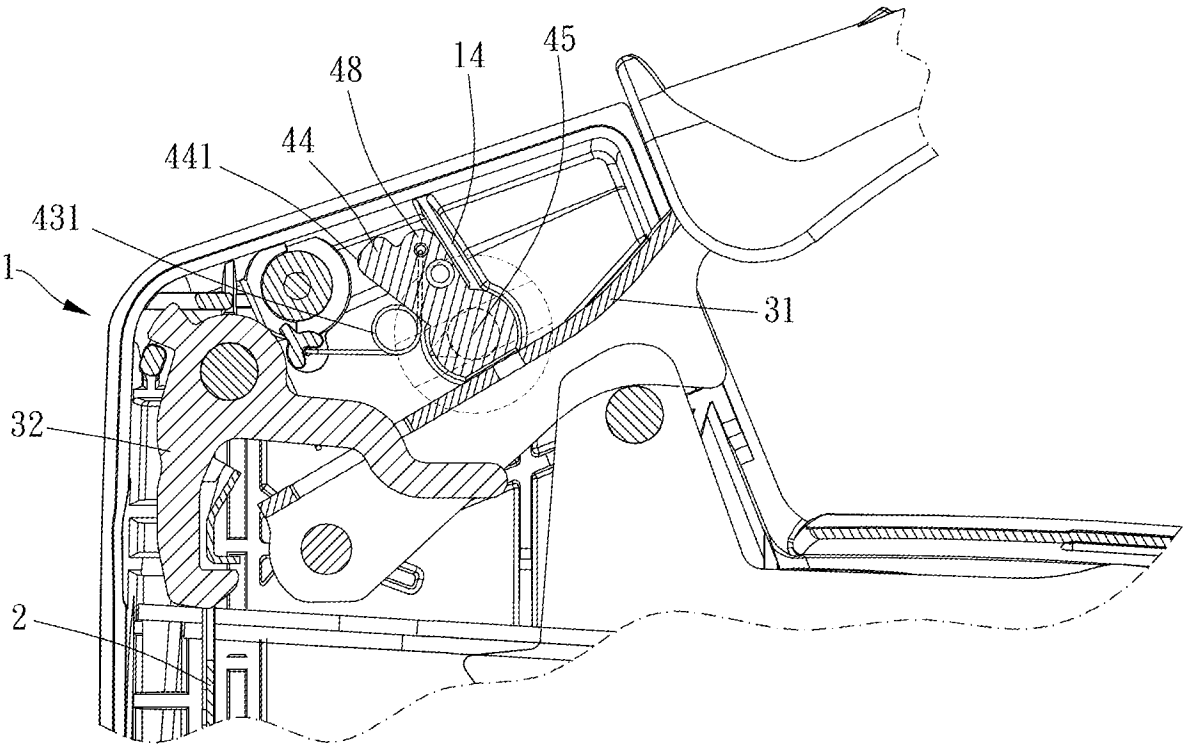
FIGS. 7 to 10 are drawings showing operation of a staple gun according to a preferable embodiment of the present invention.
Figure 8:
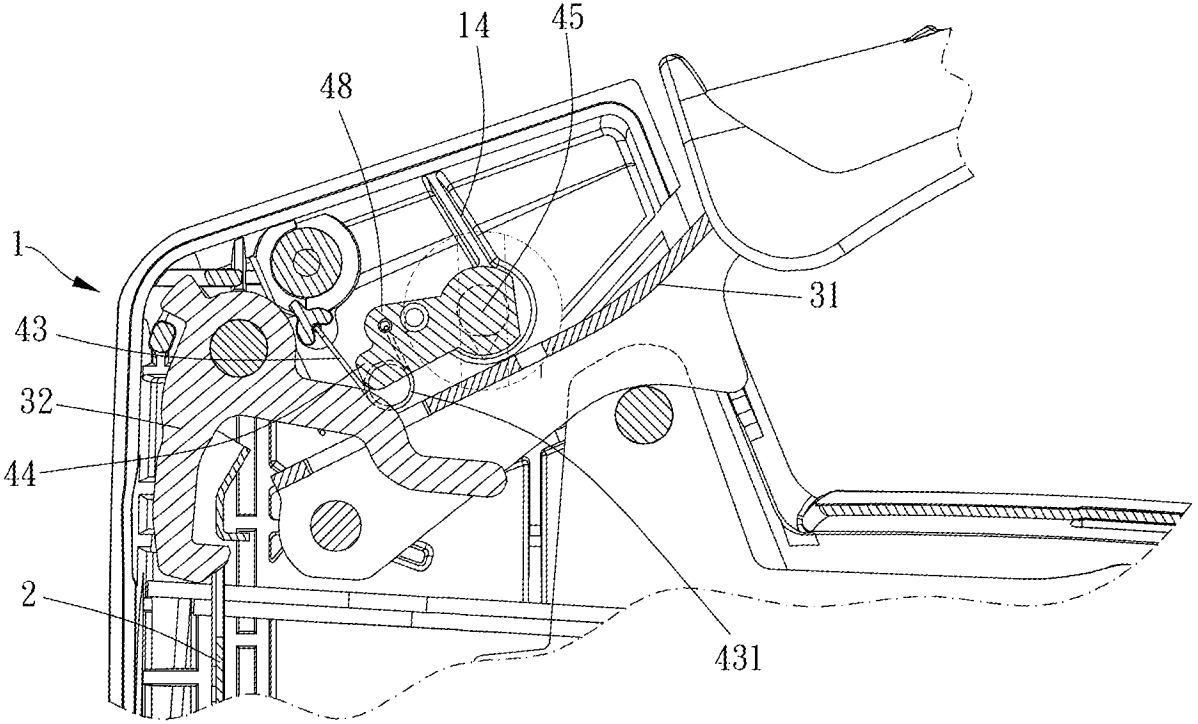
Figure 10:
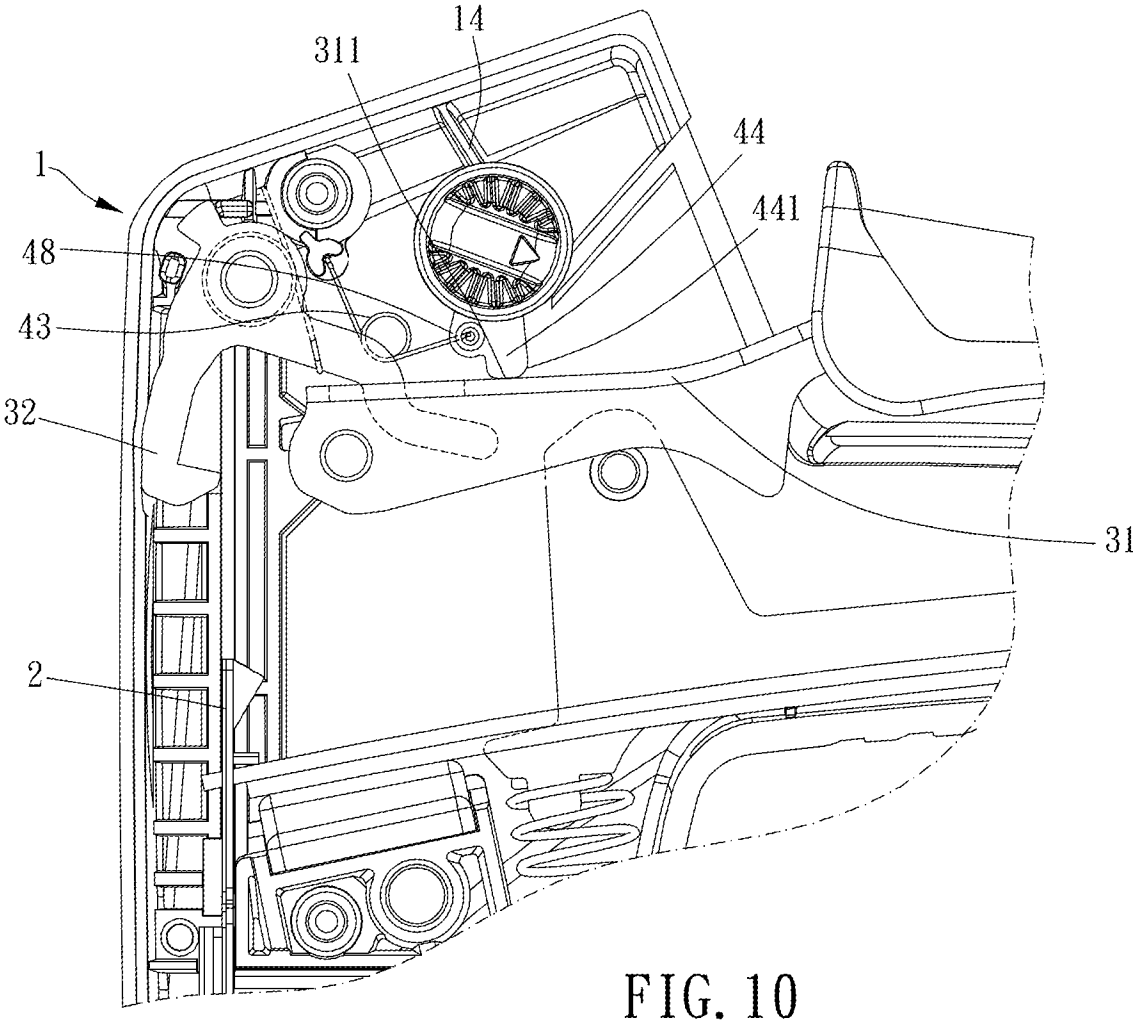

When the locking mechanism 4 is in the releasing position (as shown in FIGS. 6 and 7), the locking mechanism 4 is free of inference with the lever 31, and the lever 31 is freely rotatable between the first position and the second position; when the lever 31 swings toward the second position and the locking member 41 rotates to be in the locking position, the stopping bump 44 is abutted against a part of the lever 31 which is located inside the housing 1 (as shown in FIG. 10) so that the lever 31 is stopped by the stopping bump 44 and non-movable toward the first position and so that the lever 31 is locked, thus compacting the staple gun for easy storage. In this embodiment, the lever 31 and the housing 1 are pivotally connected by a pivot portion 15, and the stopping bump 44 is abutted against a side of the lever 31 away from the staple outlet 11 and is near the pivot portion 15 so that the stopping bump 44 is not exposed to the outside of the housing 1, thus preventing the lever 31 from being unexpectedly unlocked due to external collision.

To unlock the lever 31, it needs only to press the lever 31 toward the second position for a certain distance and the stopping bump 44 is disengaged from the lever 31, and the lever 31 is unlocked. Preferably, the stopping bump 44 includes an arcuate corner 441 facing the locking position, for easy disengagement of the stopping bump 44 from the lever 31 so that the locking member 41 can return to the releasing position and the lever 31 can return to the first position, thus being easy to use.

Specifically, the locking member 41 further includes a shaft 45 located inside the housing, and the shaft 45 is rotatably inserted into a shaft hole 12 of the housing 1. The locking member 41 further includes an operative portion 46, and the operative portion 46 projects outwardly beyond and outside the housing 1, for easy operation.

The locking member 41 further includes an annular flange 47 integrally and radially extending between the operative portion 46 and the shaft 45, the housing 1 further includes a receiving hole 13, the annular flange 47 is abutted against an inner periphery of the receiving hole 13 inside the housing 1.

The locking mechanism further includes an elastic member 43, and the elastic member 43 is abutted against and between the housing 1 and the locking member 41 so that the locking member 41 has a tendency to rotate. Specifically, the locking member 41 further includes an extending portion 48 radially extending between the annular flange 47 and the shaft 45, and the stopping bump 44 is connected with the extending portion 48, so that the stopping bump 44 has good structural strength. A radial extent of the stopping bump 44 is larger than a radial extent of the extending portion 48, for effective abutment against the lever 31. Preferably, the shaft 45, the operative portion 46, the annular flange 47, the extending portion 48 and the stopping bump 44 are integrally formed of one piece, thus being easy to manufacture and having good structural strength.

Figure 9:
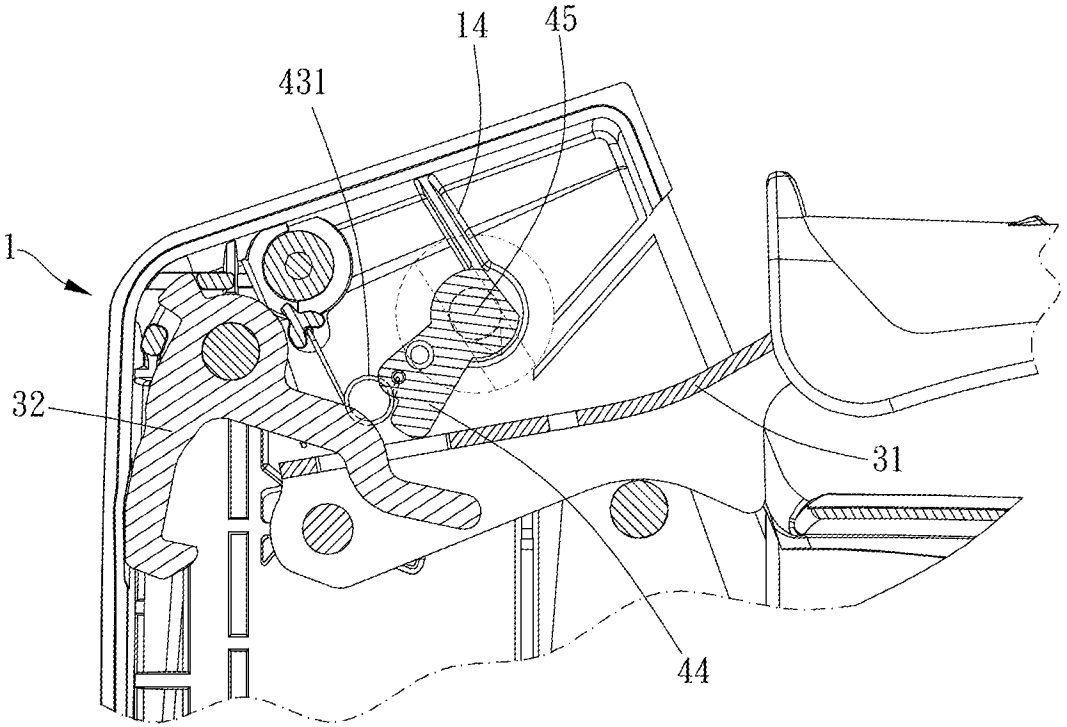

In this embodiment, the elastic member 43 is a torsion spring, one end of the elastic member 43 is inserted into the extending portion 48, and another end of the elastic member 43 is inserted to the housing 1. As viewed in the axial direction, when the one end of the elastic member 43 inserted into the extending portion 48 is higher than an extending line from the another end of the elastic member 43 to the shaft 45 (as shown in FIG. 7), and the locking member 41 has a tendency to rotate toward the releasing position; when the lever 31 moves to the second position, the locking member 41 has to be rotated toward the locking position to make the stopping bump 44 abut against the lever 31, for facilitating striking the staple; when the elastic member 43 inserted into the extending portion 48 is lower than the extending line from the another end of the elastic member 43 to the shaft 45, the locking member 41 has a tendency to rotate toward the locking position (as shown in FIG. 9), and the stopping bump 44 of the locking member 41 can drive the retaining member 32 so that the retaining member 32 is disengaged from the striking member 2; when the lever 31 is press to move to the second position, the stopping bump 44 swings toward the locking position so that the stopping bump 44 is abutted against the lever 31 and the staple cannot be stricken, thus being safe. It is noted that the elastic member may bias the locking member 41 toward the releasing position. Specifically, the elastic member 43 includes at least one coil 431 integrally connected between the one end of the elastic member 43 and the another end of the elastic member 43, and the at least one coil 431 is displaceable relative to the axial direction L, the lever 31 and the locking member 41. As viewed in the axial direction L, when the one end of the elastic member 43 inserted into the locking member 41 is higher than an extending line from the another end of the elastic member 43 to the axial direction L, the locking member 41 is biased by the elastic member 43 to rotate toward the releasing position in a first direction about the axial direction L; when the one end of the elastic member 43 inserted into the locking member 41 is lower than the extending line from the another end of the elastic member 43 to the axial direction L, the locking member 41 is biased by the elastic member 43 to rotate toward the locking position in a second direction about the axial direction L, wherein the second direction is opposite to the first direction. The lever 31 includes a flat abutting face 311 integrally formed as a part of the lever 31, the flat abutting face 311 faces toward the axial direction L, and when the lever 31 is in the locking position, the stopping bump 44 is abutted radially against the flat abutting face 311.

In this embodiment, the housing 1 further includes a blocking portion 14, and when the locking member 41 returns to the releasing position, the extending portion 48 is positionably blocked by the blocking portion 14.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A staple gun, including:

a housing, including a staple outlet;

a striking member, disposed on the housing and being movable toward or away from the staple outlet;

a driving mechanism, including a lever rotatably connected to the housing, the lever being swingable between a first position and a second position, the driving mechanism driving the striking member to move toward the staple outlet when the lever swings from the first position toward the second position;

a locking mechanism, including a locking member, the locking member disposed on the housing and rotatable about an axial direction between a releasing position and a locking position, the locking member including a stopping bump which protrudes radially and is located inside the housing;

wherein when the locking mechanism is in the releasing position, the locking mechanism is free of inference with the lever, and the lever is freely rotatable between the first position and the second position; when the lever swings toward the second position and the locking member rotates to be in the locking position, the stopping bump is abutted against a part of the lever which is located inside the housing so that the lever is stopped by the stopping bump and non-movable toward the first position;

wherein the locking mechanism further includes an elastic member, the elastic member is a torsion spring, one end of the elastic member is inserted into the locking member, another end of the elastic member is inserted to the housing, the elastic member includes at least one coil integrally connected between the one end of the elastic member and the another end of the elastic member, and the at least one coil is displaceable relative to the axial direction, the lever and the locking member;

wherein the driving mechanism further includes a retaining member rotatably connected to the housing, and when the lever is in the first position, the retaining member and the striking member are positionably engaged with each other;

wherein as viewed in the axial direction, when the one end of the elastic member inserted into the locking member is higher than an extending line from the another end of the elastic member to the axial direction, the locking member is biased by the elastic member to rotate toward the releasing position in a first direction about the axial direction; when the one end of the elastic member inserted into the locking member is lower than the extending line from the another end of the elastic member to the axial direction, the locking member is biased by the elastic member to rotate toward the locking position in a second direction about the axial direction and the stopping bump of the locking member drives the retaining member so that the retaining member is disengaged from the striking member, wherein the second direction is opposite to the first direction;

wherein an extending line from the one end of the elastic member inserted into the locking member to the another end of the elastic member inserted to the housing is always located outside the at least one coil;

wherein the locking member further includes a shaft located inside the housing, the shaft is rotatably inserted into a shaft hole of the housing, and the at least one coil displaces so that a center of the at least one coil is higher or lower than a center of the shaft relative to the lever during rotation of the locking member.

2. The staple gun of claim 1, wherein the locking member further includes an operative portion, and the operative portion projects outwardly beyond and outside the housing.

3. The staple gun of claim 2, wherein the locking member further includes an annular flange integrally and radially extending between the operative portion and the shaft, the housing further includes a receiving hole, and the annular flange is abutted against an inner periphery of the receiving hole inside the housing.

4. The staple gun of claim 3, wherein the locking member further includes an extending portion radially extending between the annular flange and the shaft, the stopping bump is connected with the extending portion, a radial extent of the stopping bump is larger than a radial extent of the extending portion, and the shaft, the operative portion, the annular flange, the extending portion and the stopping bump are integrally formed of one piece.

5. The staple gun of claim 4, wherein the one end of the elastic member is inserted into the extending portion.

6. The staple gun of claim 5, wherein the housing further includes a blocking portion, and when the locking member returns to the releasing position, the extending portion is positionably blocked by the blocking portion.

7. The staple gun of claim 1, wherein the stopping bump includes an arcuate corner facing the locking position.

8. The staple gun of claim 1, wherein the lever and the housing are pivotally connected by a pivot portion, and the stopping bump is abutted against a side of the lever away from the staple outlet and is near the pivot portion.

9. The staple gun of claim 1, wherein when the lever move to the second position, the retaining member is driven by the lever to disengage from the striking member so that the striking member is movable toward the staple outlet.

10. The staple gun of claim 1, wherein the lever includes a flat abutting face integrally formed as a part of the lever, the flat abutting face faces toward the axial direction, and when the lever is in the locking position, the stopping bump is abutted radially against the flat abutting face.

* * * * *